US005296830A

United States Patent [19]

Tamada et al.

[11] Patent Number: 5,296,830

[45] Date of Patent: Mar. 22, 1994

[54] CHOKE COIL

[75] Inventors: Teruo Tamada; Shigeru Kameyama; Koji Arakawa, all of Tsurugashima, Japan

[73] Assignee: Toko Kabushiki Kaisha, Tokyo, Japan

[21] Appl. No.: 886,285

[22] Filed: May 21, 1992

[30] Foreign Application Priority Data

May 27, 1991 [JP] Japan ..... 3-47415[U]

[51] Int. Cl.[5] ..... H01F 15/10; H01F 27/30

[52] U.S. Cl. ..... 336/192; 336/198; 336/223

[58] Field of Search ..... 336/192, 198, 223, 232; 310/71

[56] References Cited

U.S. PATENT DOCUMENTS

| | | | |
|---|---|---|---|
| 217,466 | 7/1879 | La Conte | 336/223 |
| 926,964 | 7/1909 | Schrader | 336/223 |
| 2,963,669 | 12/1960 | Salisbury | 336/192 |
| 3,737,990 | 6/1973 | Schut | 336/223 |
| 3,771,086 | 11/1973 | Poulsen | 336/192 |
| 3,826,967 | 7/1974 | Wilkinson et al. | 336/232 |
| 4,127,933 | 12/1978 | Hansen et al. | 336/223 |
| 4,146,858 | 3/1979 | McDermott | 336/223 |
| 4,507,640 | 3/1985 | Rich, III et al. | 336/232 |

FOREIGN PATENT DOCUMENTS

| | | | |
|---|---|---|---|
| 55-74115 | 6/1980 | Japan | 336/223 |
| 55-120116 | 9/1980 | Japan | 336/223 |
| 4-114417 | 4/1992 | Japan | 336/223 |

OTHER PUBLICATIONS

IBM Technical Disclosure Bulletin, "Solderfree Printed Circuit Mountable Transformer," Maroon et al., vol. 27, No. 1A, Jun. 1984, pp. 146, 147.

IBM Technical Disclosure Bulletin, "Flat Winding Transformer," Radcliffe, vol. 22, No. 9, Feb. 1980.

*Primary Examiner*—Thomas J. Kozma

*Attorney, Agent, or Firm*—Stevens, Davis, Miller & Mosher

[57] ABSTRACT

An object of the present invention is to provide a structure for a choke coil which facilitates making choke coils more compact, thinner and easier to manufacture. The structure uses a band-shaped conductor, the terminal portions at both ends are fixed in a terminal fixing plate provided to one end of the winding portion of a bobbin.

6 Claims, 3 Drawing Sheets

CHOKE COIL

BACKGROUND OF THE INVENTION

The present invention relates to the structure of a choke coil for high-frequency power use and which is suitable to make the coil more compact and thinner.

The requirements in development for more compact and thinner electronic apparatus for switching power and the like have been continued as they are directly linked to the requirement for more compact electronic parts.

In particular, there is a great demand for more compact choke coils which are one electronic part which requires a particularly large area.

So far, choke coils have been designed with regards to the ease of manufacture of the product, and efficient combinations of a core and a coil within a predetermined volume.

FIG. 8 is a partial sectional view of a conventional choke coil, and shows a general configuration where a wire member 22 is wound around a bobbin 21 into which a core 20 is inserted, and where the ends of a wire member 22 are connected to the terminal pins 23.

This structure is easy to manufacture but it makes gaps between the wire members and so the volume of the wound wire member, that is, the coil becomes large.

FIG. 9 is a partial sectional view of a different type of conventional choke coil, and where a band-shaped conductor 32 is wound around a bobbin 31 into which a core 30 is inserted, and separate leads 33 electrically connected to the band-shaped conductor 32 are connected to terminal pins 34 provided to the bobbin 31.

A structure, where a band-shaped conductor is wound, has the advantage of having a smaller volume for the wound coil, compared with a structure where a wire member is wound. The band-shaped conductor 32 is connected to a terminal pins 34 via leads 33 and so connecting the leads 33 involves a connection process using either soldering or welding to the band-shaped conductor 32, and so there is room for improvement as far as ease of manufacture is concerned.

Conventional choke coils have various technical problems as described above, and are unsuitable as regards making the coil more compact, thinner and easier to manufacture.

SUMMARY OF THE INVENTION

An object of the present invention is to provide a choke coil which is suited to be made more compact and thinner, and which is easier to be manufactured.

The choke coil of the present invention has a bobbin provided with a cylindrical winding portion, and a terminal fixing plate which protrudes from the periphery to the outer side of one end of this winding portion, a band-shaped conductor which is wound around the winding portion, and a core which is inserted into the winding portion, and both ends of the band-shaped conductor are provided with terminal portions which extend in one direction perpendicular to the longitudinal direction, while the band-shaped conductor fixes the start and the end of the coil in the bobbin in the status where terminal portions sandwich the opposing side surfaces of the terminal fixing plate.

DETAILED DESCRIPTION OF PREFERRED EMBODIMENTS

Figure 1:
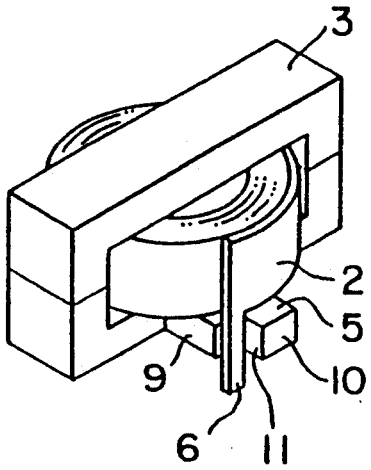
FIG. 1 is an assembly perspective view showing an embodiment of the choke coil according to the present invention.

The following is a description of a preferred embodiment of the choke coil according to the present invention with reference to FIGS. 1 through 7.

In FIGS. 1 through 7, 1 is a bobbin comprising synthetic resin, 2 is a band-shaped conductor of copper and which has had insulation processing implemented for its surface, and 3 is an E-type core comprising ferrite.

The bobbin 1 is provided with a cylindrical winding portion around which a band-shaped conductor 2 is wound, and a terminal fixing plate 5 which protrudes from the periphery on the lower side of the winding portion 4 to the outer side. To one side of the side surface 9 of the terminal fixing plate 5, a cutout portion 11 leading to the end surface 10 is provided. The terminal fixing plate 5 has the function of fixing the ends of the band-shaped conductor 2.

The terminals of the band-shaped conductor 2 are formed in the shape of a letter "L" and the portion which extends in the direction perpendicular to the longitudinal direction is provided as the terminal portion 6. The insulation processing is implemented for either the entire surface or half of the surface, with the exception of the terminal portion 6.

The E-shaped cores 3 are inserted into the winding portion 4 of the bobbin 1 and the left and right legs 8 are on the outer side of the winding portion 4, and the two E-shaped cores 3 are fixed to the bobbin 1 in the status where the same portions are in mutual contact from the top and the bottom.

Figure 7:
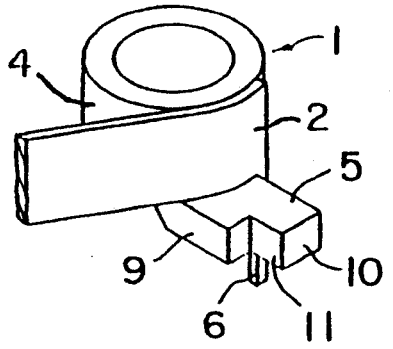
FIG. 7 is a perspective view showing the start of the coil winding of the band-shaped conductor.
Figure 8:
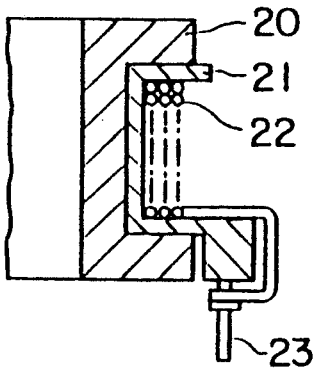
FIG. 8 PRIOR ART
FIG. 8 is a partial sectional view showing a conventional choke coil.
Figure 9:
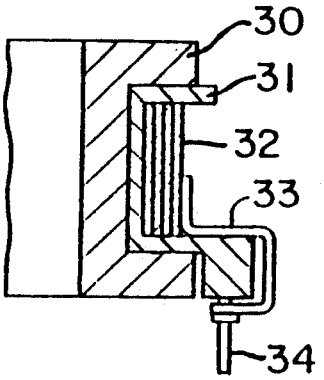
FIG. 9 PRIOR ART
FIG. 9 is a partial sectional view showing another conventional choke coil.

As shown in FIG. 7, the band-shaped conductor 2 has the terminal portion 6 which is the start of the winding fixed in the side surface 9 of the terminal fixing plate 5, and is wound around the winding portion 4 of the bobbin 1. Then, as shown in FIGS. 2 and 3, the winding end is fixed in the cutout portion 11 of the side surface 9 on the opposite side of the winding start.

The terminal portion 6 at both ends of the band conductor 2, which is made of a material able to provide a spring force, is fixed in the terminal fixing plate 5 in the status, where the terminal portion 6 sandwich the opposing side surfaces of the terminal fixing plate 5, and is securely held by the spring force of the band-shaped conductor 2.

Figure 2:
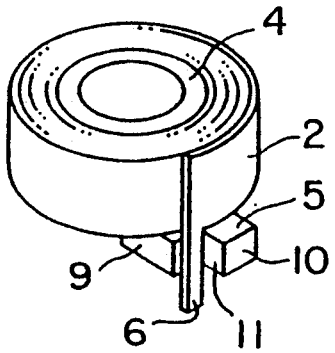
FIG. 2 is an assembly perspective view showing the status where the core is removed.
Figure 3:
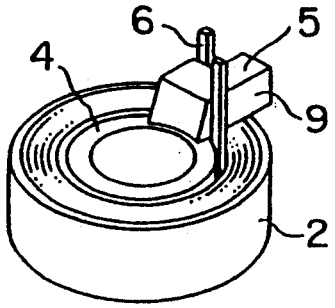
FIG. 3 is an assembly perspective view from the underside and showing the status where the core is removed.
Figure 4:
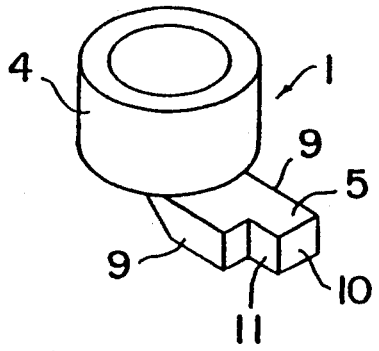
FIG. 4 is a perspective view of the bobbin.
Figure 5:
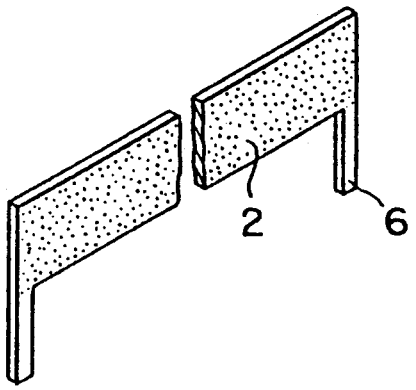
FIG. 5 is a perspective view of the band-shaped conductor.
Figure 6:
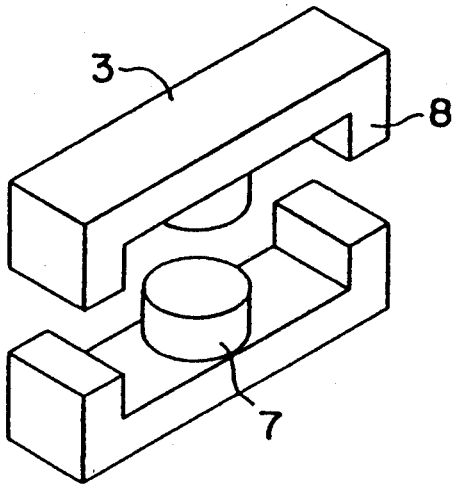
FIG. 6 is a perspective view of the core.

As shown in FIGS. 1 and 2, the terminal portion 6 is formed so that it extends perpendicularly to the downwards direction of the terminal fixing plate 5 and so that it can be inserted into the circuit substrate and it can also be surface mounted to a conductor pattern of a circuit substrate by bending it horizontally midway.

Not relating with fixing plate 5, collar can be provided to the upper side and the lower side of the winding portion 4.

The core is not necessarily limited to an E-type core, and can be a combination of an E-type core and an I-type core, for example.

The cutout portion 11 of the terminal fixing plate 5 is provided so as to ensure definite fixing of the winding end, but this cutout portion 11 need not be provided sometimes.

EFFECT OF THE INVENTION

As has been described above, the choke coil of the present invention use band-shaped conductors in a structure where a winding start and a winding end are fixed to a terminal fixing plate of a bobbin. The band-shaped conductor fixes the terminal portions of both ends in the status where they are sandwiched between opposing side surfaces of a terminal fixing plate.

The band-shaped conductor is wound and so the shape of the winding is smaller when compared with a winding of wound wire. In addition, the bobbin has only a winding portion and a terminal fixing plate, and so the height of the bobbin is reduced.

This further contributes to making the choke coil more compact and thinner.

In addition, the terminal portion is provided as a unit to the band-shaped conductor, and so terminal pins do not have to be provided to the bobbin, and so it is not necessary to have a lead connecting the terminal pin and the band-shaped conductor, or to have work for connecting that lead to a terminal pin.

This is directly linked to the ease of manufacturing the product.

The structure of the choke coil of the present invention is excellent as regards its being more compact, thinner and easier to manufacture.

What is claimed is:

1. A choke coil comprising:

a bobbin provided with a cylindrical winding portion;

a terminal fixing plate which is attached to said bobbin and which protrudes rom the periphery to the outer side of one end of said cylindrical winding portion;

a band-shaped conductor which is made of a conductive material which provides a spring force and which is wound around said cylindrical winding portion, both ends of said band-shaped conductor being provided with terminal portions which extend in one direction perpendicular to the longitudinal direction, and said band-shaped conductor being fixed in the status where said terminal potions sandwich opposing side surfaces of said terminal fixing plate and are held against said terminal fixing plate by said spring force applied by said band shaped conductor as said spring force urges said band-shaped conductor into an unwound state, thus causing said terminal portions to engage said bobbin.

2. The choke coil of claim 1, wherein a cutout portion leading to a terminal surface is provided to a side surface of one side of said terminal fixing plate, and a winding end of a band-shaped conductor is fixed in said cutout portion, and a winding start is fixed in another side surface.

3. A choke coil comprising:

a bobbin provided with a cylindrical winding portion;

a terminal fixing plate which is attached to said bobbin and which protrudes from the periphery to the outer side of one end of said cylindrical winding portion;

a band-shaped conductor which is made of a conductive material which provides a spring force and which is wound around said cylindrical winding portion; and a core which is inserted into said cylindrical winding portion;

both ends of said band-shaped conductor being provided with terminal portions which extend in one direction perpendicular to the longitudinal direction, a winding of said band-shaped conductor being started by engaging one of said terminal portions with a first side surface of said terminal fixing plate and completed by engaging the other of said terminal portions with said terminal fixing plate by said spring force as said spring force urges said band-shaped conductor into an unwound state.

4. A choke coil as in claim 3, wherein a cutout portion leading to an end surface is provided at one side of said terminal fixing plate, and the end of said band-shaped conductor is engaged with the other side surface.

5. A choke coil as in claim 1, wherein said terminal fixing plate is of a one-piece construction with said bobbin

6. A choke coil as in claim 3, wherein said terminal fixing plate is of a one-piece construction with said bobbin.

* * * * *